United States Patent [19]

Poole

[11] Patent Number: 4,855,737

[45] Date of Patent: Aug. 8, 1989

[54] TRACK CIRCUIT SIGNALLING ARRANGEMENT

[75] Inventor: Damian M. Poole, Timperley, United Kingdom

[73] Assignee: General Signal Corporation, Stamford, Conn.

[21] Appl. No.: 77,831

[22] Filed: Jul. 27, 1987

[30] Foreign Application Priority Data

Aug. 4, 1986 [GB] United Kingdom ..... 8619013

[51] Int. Cl.[4] ..... G08G 1/01; B61L 29/00

[52] U.S. Cl. ..... 340/933; 246/473.1; 246/3; 246/187 R; 246/65

[58] Field of Search ..... 340/47–49, 340/345–351, 933; 246/3, 187 R, 66, 187 A, 187 C, 63 C, 62, 65; 375/96; 371/52

[56] References Cited

U.S. PATENT DOCUMENTS

| | | | |
|---|---|---|---|
| 3,532,877 | 10/1970 | Thorn-Booth | 246/63 C |
| 3,568,149 | 3/1971 | Sibley | 371/52 |
| 3,718,813 | 2/1973 | Williams, Jr. et al. | 375/96 |
| 4,314,237 | 2/1982 | Darrow | 340/47 |
| 4,516,249 | 5/1985 | Cook et al. | 375/96 |
| 4,582,279 | 4/1986 | Pontier | 340/433 |

FOREIGN PATENT DOCUMENTS

| | | |
|---|---|---|
| 1544953 | 4/1979 | United Kingdom . |
| 1546942 | 5/1979 | United Kingdom . |
| 2085207 | 4/1982 | United Kingdom . |

*Primary Examiner*—Donnie L. Crosland
*Attorney, Agent, or Firm*—Ronald Reichman

[57] ABSTRACT

A digital signal is used for railway track circuit signalling. A digital signal comprises a pseudo-random binary sequence selected from a set of such sequences. The set is chosen to give the lowest possible cross-correlation between different sequences, to minimize the risk of false identification. Gold codes are suitable. One of the sequences indicates the absence of a train from the track section and this code is generated until an indication is give by a train detector that a train is present. Generation of the train absence signal is then inhibited, and other sequences are generated providing information to the train. The generated sequences are received and coded in a fail-safe decoder.

5 Claims, 3 Drawing Sheets

TRACK CIRCUIT SIGNALLING ARRANGEMENT

SUMMARY OF THE INVENTION

A digital signal is used for railway track circuit signalling. The digital signal comprises a pseudo-random binary sequence selected from a set of such sequences. The set is chosen to give the lowest possible cross-correlation between different sequences, to minimize the risk of false identification. Gold codes are suitable.

One of the sequences indicates the absence of a train from the track section and this code is generated until an indication is given by a train detector that a train is present. Generation of the train absence signal is then inhibited, and other sequences are generated providing information to the train. The generated sequences are received and decoded in a fail-safe decoder.

TRACK CIRCUIT SIGNALLING ARRANGEMENT

This invention relates to track circuit signalling.

Railway signalling track circuits provide a means for detecting the position of a train on the track in order to control its movement and thereby prevent accidents. The track is conventionally divided into sections by means of insulated joints in one or both rails, or by some other ("jointless") electrical configuration which achieves the same effect. A transmitter is connected between the rails at one end of the section and a receiver at the other end. The receiver is normally energised from the transmitter by way of the rails. In the presence of a train in the section the rails are short-circuited so de-energizing the receiver which thereby indicates the presence of the train.

In a system in which the motive power of the railway is provided by electric traction, the return path for the traction current is conventionally provided by the rails themselves. In this event steps must be taken to prevent the traction current from interfering with the operation of the track circuit, and in particular to ensure that the receiver cannot be energised by the traction current while the train is in the section.

In order to achieve these ends it is conventional to modulate the transmitted track circuit signal at a specific rate. The modulation rate can be detected at the receiver and hence the track circuit signal can be distinguished from interference caused by the traction system.

It is convenient to use the track circuit transmitter also to send, for example, safety speed limit commands to the train when it is in the section. These commands are picked up by coils mounted in front of the leading axle of the train and are also subject to traction interference. By modulating the transmitted signal at various rates, different commands may be sent to the train with protection against interference.

The object of this invention is to provide a track circuit signalling arrangement in which the steady rate or rates of modulation for track circuit and/or train control functions are replaced with digital bit sequences.

According to the invention a track circuit signalling arrangement wherein a carrier signal arranged to be transmitted along rails is modulated with digital signal comprises a correlator arranged to correlate a received digital signal against a reference signal and to provide an output indicative of whether the received signal corresponds substantially to the reference signal. The arrangement preferably comprises thresholding means arranged to indicate whether said output exceeds a predetermined level.

The digital signal is preferably one of a plurality of digital code sequences which are selected so that said output is below a predetermined level when any of the code sequences other than the selected one is correlated against the reference signal, the predermined level being below the average output level produced by correlation of random code sequences against the reference signal. The digital code sequences may be Gold codes.

The correlator may comprise a multi-stage shift register through which the received signal is arranged to be shifted, and wherein the output from each stage of the shift register is arranged to be connected to a respective impedance, the impedances being connected in a pattern corresponding to the reference signal so that the output from the correlator is a maximum when the outputs from the shift register correspond exactly to the reference signal.

According to another aspect of the invention a track circuit signalling arrangement comprises for each section of the track circuit a code generator to generate one of a plurality of binary code sequences, a modulator to modulate a carrier signal with the generated binary code sequence, a correlator to correlate a received binary code sequence against a stored sequence and to provide an output indicative of whether the received sequence corresponds to the stored sequence, and train detector means arranged to indicate the presence of a train in the section, wherein one of the binary code sequences indicates the absence of a train in that section and said code generator inhibits the generation of the sequence indicating the absence of a train in response to an indication of train absence from the train detector means.

The code generator may be arranged to generate a binary code sequence conveying information to the train in the section in response to an indication of train presence from the train detector means. The stored sequence may be the sequence indicating the absence of a train and comprising means to indicate the absence of a train in the section only when the train detector means indicates such absence and the output from said correlator indicates that the received sequence corresponds to the stored sequence.

One embodiment of the invention will now be described by way of example with reference to the accompanying drawings of which:

The information to be conveyed either to a train or the track relay is encoded in the form of pseudo-random binary sequences, and a carrier signal is modulated with these sequences. At the receiver, the signal is demodulated and the digital sequence correlated against a stored sequence. The result, called the cross-correlation, is a measure of the similarity between the two sequences. The incoming sequence is taken to be the stored sequence when the cross-correlation exceeds a certain threshold value.

Figure 1:
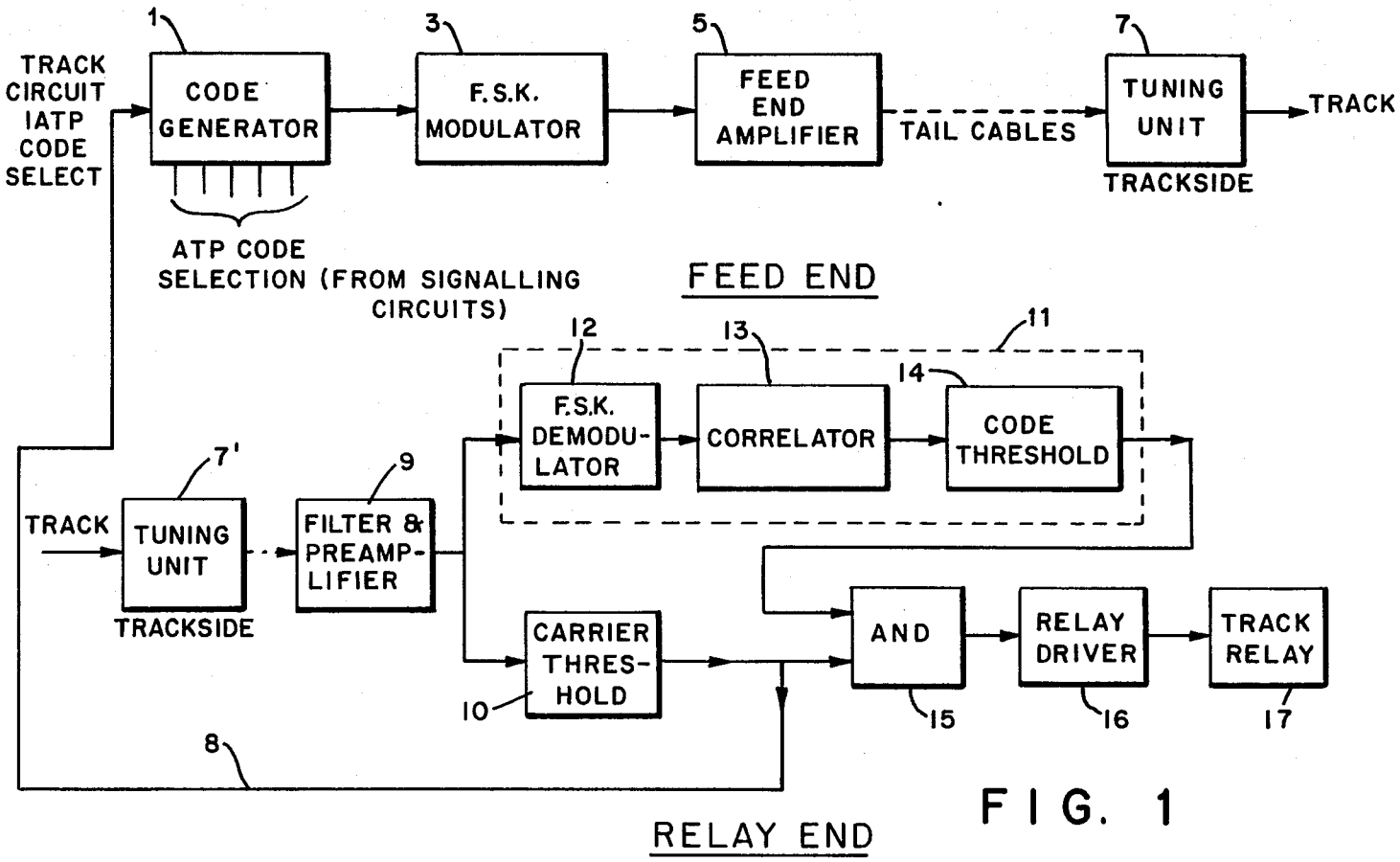
FIG. 1 is a block diagram of a track circuit signalling system in accordance with the invention.

FIG. 1 shows the signalling system for one section of a track circuit. The signal feed end of the system comprises a code generator 1, frequency shift keying (f.s.k.) modulator 3, amplifier 5 and tuning unit 7. The coded signal is fed from the tuning unit to the tracks at one end (the 'feed end') of the track circuit section and picked up at the other end by what is known as the relay end of the system. This relay end comprises a further tuning unit 7', a filter and preamplifier 9, carrier threshold 10, decoding unit 11 and an AND gate 15 connected to the relay driver 16 which activates the tract relay 17. The decoding unit 11 comprises a f.s.k. demodulator 12, correlator 13 and code threshold 14.

When no train is present in the section the code generator 1 generates continuously a particular binary digital code. The code is impressed upon the a.c. carrier signal, derived from an a.c. generator not shown, by f.s.k. modulator 3 which shifts the carrier frequency slightly up or down according to the value of the code elements '0' and '1'. After amplification the signal is transmitted via cables to the tuning unit 7 at the trackside and thence to the track itself. The bandwidth of the tuning unit encompases both frequencies of the modulated signal.

This train absence signal is picked up from the tracks at the opposite end of the track circuit section by the further tuning unit 7' which is located at the trackside. Cables carry the signal to the filter and preamplifier 9. The output from here goes both to the carrier threshold 10 and the decoding unit 11. The carrier threshold 10 is set at an amplitude level (which may be zero) above which the absence of a train is indicated. When a train is present in the track circuit section the current is shunted by the train axle causing the track current to fall. While no train is present the input to the AND gate 15 from the carrier threshold 10 is a logic 'one'. The other input to the AND gate is the output from the decoding unit 11 which is a logic 'one' only if the correct code is being received at the correlator 13. The correlator is preloaded into the "train absence" code as described below so that for any received code which is not close to or identical to this "train absence" code the output from the correlator is below the code threshold. The output from the code threshold device 14 is then a logic zero.

Only if both the carrier threshold 10 and the code threshold 14 indicate the absence of a train will the output of AND gate 15 be a logic one. The output is fed to relay driver 16 and thence to the track relay 17.

Figure 2:
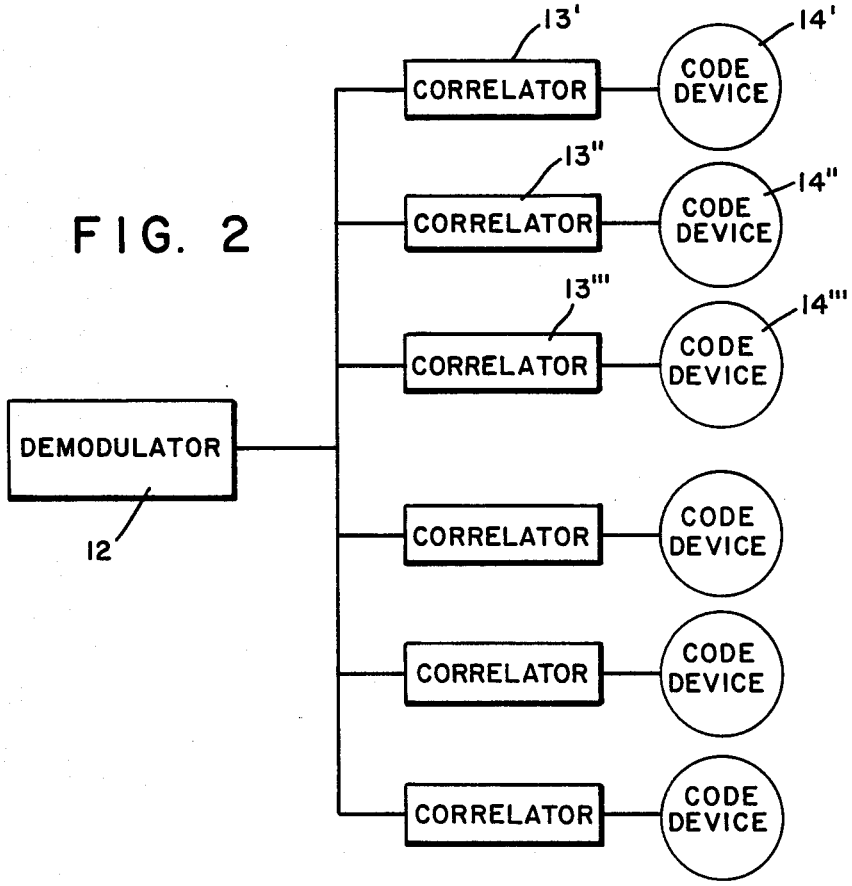
FIG. 2 is a block diagram of receiving equipment on board a train.

When a train enters the track circuit section the signal amplitude falls below the carrier threshold and, regardless of the code threshold output, the output from AND gate 15 is a logic zero indicating to the track relay the presence of a train. The output from the carrier threshold is also used via feedback path 8 to control the code generator 1. While the received signal amplitude exceeds the carrier threshold the code generator continues to generate the "trail absence" code. However once the signal amplitude falls below the carrier threshold, the signal on feedback path 8 controls the code generator 1 to generate one of a selection of automatic train protection (ATP) codes. Which code is selected is determined by the condition of the signalling circuits. The ATP codes carry information to the train itself each code carrying a different message, such as speed limit. The coded signals are transmitted to the track in the same way but are picked up by receiving equipment on the train. An outline of the receiving equipment is shown in FIG. 2. In order to be able to identify which an incoming code is of a number of possible codes, the demodulated signal from f.s.k. demodulator 12' is fed through a bank of correlators 13', 13'' etc. Each correlator is preloaded with a different reference code, for example corresponding to speed limits of 5 m.p.h., 10 m.p.h. etc. If one of these codes is received the corresponding code threshold device 14', 14'' etc. gives an output signal which produces an appropriate signal on the driver's display or control panel e.g. by lighting a lamp or writing a message to a VDU. The correlation process here could be performed by software.

The ATP code sequences might also be picked up by the relay and tuning unit 7' but they will not activate the track relay because the relay correlator 13 is preloaded to provide a logic 'one' output only on detection of the "train absence" code and further because the signal amplitude will be below the carrier threshold throughout the time that a train is present in the section.

The fundamental safety requirement of a decoder designed for railway signalling purposes is that it shall not indicate that it is receiving a particular code when it is not in fact receiving that code; this requirement must be met under all credible circumstances including component failures within the decoders itself. It is embodied in the description "fail-safe".

The failure of any component in the shift register or the summing network will result in a reduction in the ratio of the peak value to the average at the output of the summing network and hence the "fail-safe" requirement for the decoder is met.

Clearly it is desirable for the different code sequences to have the lowest possible cross-correlation to minimise the possibility of one code being mistaken for another after corruption by interference. Cross-correlation values have been predicted mathematically for certain families of sequences. Families having suitably low crosscorrelation values are chosen for use with this invention. The number of codes available is considerably larger than the number of different modulation rates which can be generated and safely distinguished by conventional track circuit arrangements, so that range of information which can be conveyed to the train by this method is considerably increased.

Gold codes are one example of codes suitable for use with this invention. Gold codes are generated by shift registers whose "generating polynomial" is the product of two other polynomials each of which generates a maximal sequence.

Pseudo-random binary sequences may be generated by a shift register, the input of which is the modulo-2 sum of the outputs of 2 or more stages of the shift register. The modulo-2 addition is performed by exclusive-OR gates. If the shift register has n stages its contents can take up $2^n$ different states. If the feedback connections are chosen correctly the register will cycle through $2^{n-1}$ states (the all-zeros state is excluded) thus generating a sequence $2^{n-1}$ bits in length. Such a sequence is called a maximal pseudo-random sequence. Methods of choosing appropriate feedback connections are well documented.

The shift register circuit may be described by a "generating polynomial" of the form $$f(x)=1+x^{n1}+x^{n2}+\ldots$$

where n1, n2 etc. are the numbers of the stages from which the feedback connections are taken, e.g. the circuit shown above would have the generating polynomial $$f(x)=1+x+x^2+x^3+x^7$$

If this polynomial is multiplied (modulo−2) by, for example, $$f^1(x)=1+x+x^2+x^3+x^4+x^5+x^7$$

which generates another maximal sequence, the resulting product polynomial $$g(x)\cdot f^1(x)=1+x^2+x^6+x^8+x^{11}+x^{12}+x^{14}$$

generates sequences having, as described, by Gold, a maximum cross-correlation of $2\frac{1}{2}(n+1)+1$ if n is odd or $2\frac{1}{2}(n+2)+1$ if n is even.

There will be $2^n+1$ such sequences, each of length $2^n-1$, the actual sequence generated being determined by the initial state of the shift register.

Thus the product polynomial g(x) above will generate 129 different sequences of length 127 having a maximum cross-correlation of 17.

Figure 3:
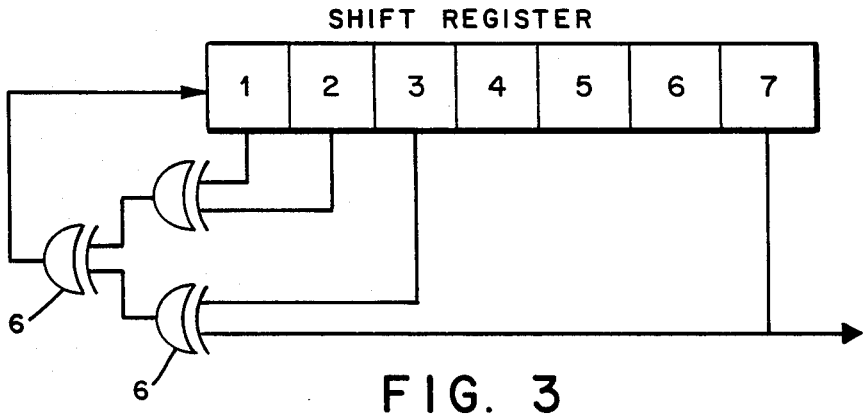
FIG. 3 shows a feedback shift register.
Figure 4:
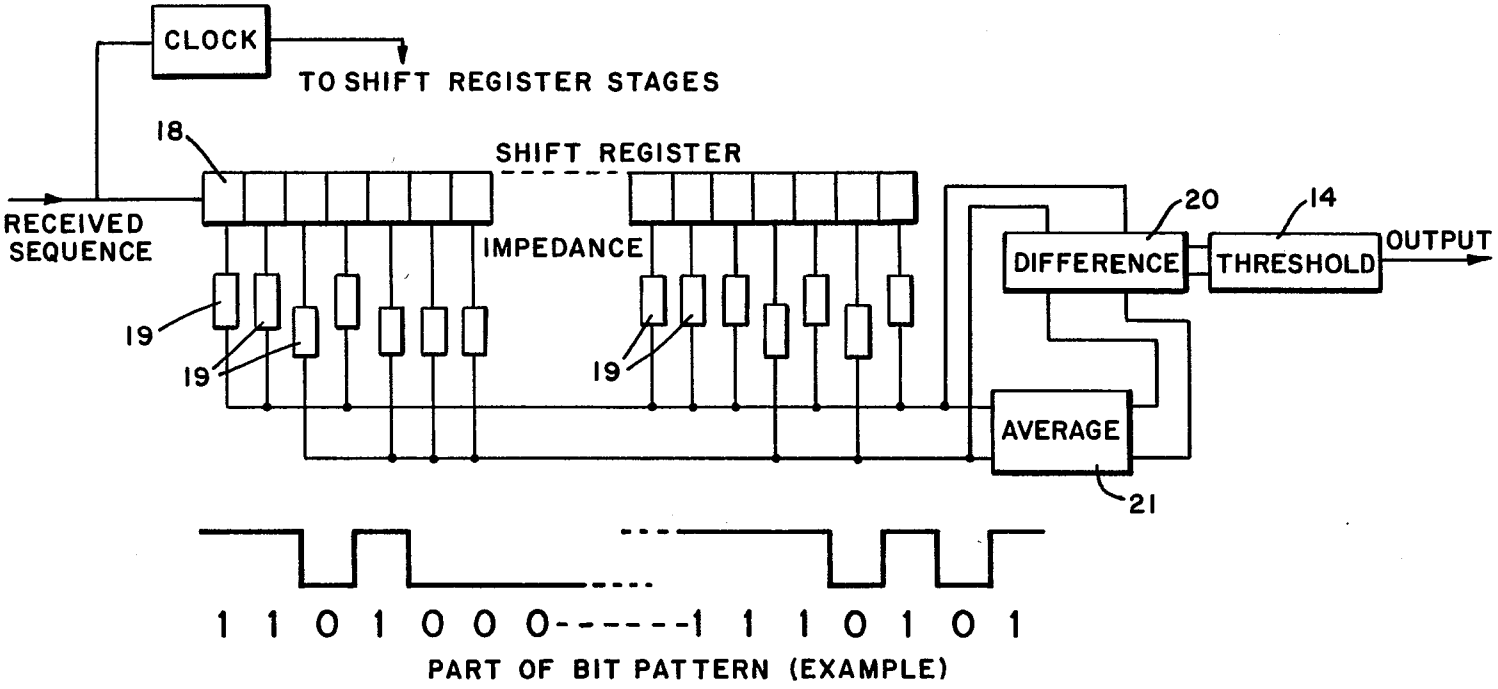
FIG. 4 is a schematic diagram of a correlator for use with the invention.

FIG. 3 shows the correlator 13. Correlators 13', 13'' etc. are identical. The correlator comprises a shift register 18, the outputs of the several stages of which are summed by a network of impedances 19. The impedances 19 are connected in a pattern corresponding to that of the zeroes and ones in the code which the decoder is intended to detect.

The received sequence is shifted through the register 18, and if and when the pattern of bits in the received sequence matches the pattern of impedance connections in the summing network then a large peak signal is obtained at the output of the network.

In order to determine whether the expected sequence is present, a differencing circuit 20 measures the ratio of the signal at the output of the summing network to its average value measured by an averaging circuit 21. This ratio is then compared with a predetermined threshold. If this threshold is exceeded then the expected sequence is assumed to be present. By suitable adjustment of the threshold value the presence of the sequence can be detected even when it has been partially corrupted by interference.

The code sequences employed are specified so that at all other shifts and for all other codes, the output of the summing network is less than a specified, relatively low, value.

The above specification describes a new and improved track circuit signalling arrangement. It is realized that the above description may indicate to those skilled in the art additional ways in which the principles of this invention may be used without departing from its spirit. It is, therefore, intended that this invention be limited only by the scope of the appended claims.

What is claimed is:

1. A track circuit signalling arrangement wherein a carrier signal transmitted along rails is modulated with a pseudo-random binary sequence, said arrangement comprising: a correlator for correlating a received said binary sequence against a stored sequence, said correlator comprising a multistage shift register to which said received signal is applied serially, an output from each stage of said shift register being connected to one or other of two lines in a predetermined pattern of connections said pattern of connections constituting said stored sequence, and output means connected to said two lines for providing an indication of the correspondence between said received sequence and said stored sequence.

2. A signalling arrangement according to claim 1 wherein said digital code sequences are Gold codes.

3. A track circuit signalling arrangement according to claim 1 comprising for each of a plurality of sections of the track circuit, a code generator for generating a train absence binary code sequence, a modulator for modulating a carrier signal in accordance with said train absence binary code sequence, said code generator being connected to said modulator, means for coupling the modulated carrier signal to the respective track section at one end of said section; said correlator being connected to said track section at the other end for receiving said carrier signal modulated in accordance with said train-absence binary code sequence, said correlator being connected to said output means to provide an output indicative of whether the received binary code sequence corresponds to said stored sequence, and train detector means connected in the respective section of track circuit for indicating the presence of a train in said respective section and said train detector means being connected to said code generator to inhibit the generation of said train absence binary code sequence in the presence of a train in said respective section.

4. A track circuit signalling arrangement according to claim 3 wherein said code generator is arranged to generate a binary code sequence conveying information to said train in said section in response to an indication of train presence from said train detector means.

5. A track circuit signalling arrangement according to claim 3 or 4 wherein said stored sequence in said sequence indicating the absence of a train and comprising means to indicate the absence of a train in said section only when said train detector means indicates such absence and said output from said correlator indicates that said received sequence corresponds to said stored sequence.

* * * * *